US008905520B2

(12) United States Patent
Mercadé et al.

(10) Patent No.: US 8,905,520 B2
(45) Date of Patent: Dec. 9, 2014

(54) SYSTEM FOR ADJUSTING THE BASE OF THE PRINT HEAD OF A PLOTTER

(75) Inventors: Antoni Balsells Mercadé, Key Biscayne, FL (US); Francesc Masgrau Lagresa, Banyoles-Girona (ES); Antoni Guimerá Pedrola, Sant Sadurní D'anoia-Barcelona (ES)

(73) Assignee: TKT Brainpower, S.L., Barcelona (ES)

( * ) Notice: Subject to any disclaimer, the term of this patent is extended or adjusted under 35 U.S.C. 154(b) by 0 days.

(21) Appl. No.: 13/577,538

(22) PCT Filed: Feb. 8, 2011

(86) PCT No.: PCT/ES2011/070082

§ 371 (c)(1), (2), (4) Date: Nov. 27, 2012

(87) PCT Pub. No.: WO2011/098646

PCT Pub. Date: Aug. 18, 2011

(65) Prior Publication Data

US 2013/0093816 A1 Apr. 18, 2013

(30) Foreign Application Priority Data

Feb. 9, 2010 (ES) ..... 201030174

(51) Int. Cl.

| | |
|---|---|
| ***B41J 25/316*** | (2006.01) |
| ***B41J 25/308*** | (2006.01) |
| ***B41J 2/14*** | (2006.01) |
| ***B41J 2/21*** | (2006.01) |

(52) U.S. Cl.

CPC ..... *B41J 25/3086* (2013.01); *B41J 25/316* (2013.01); *B41J 2/14024* (2013.01); *B41J 2/2135* (2013.01); *B41J 25/308* (2013.01)

USPC ..... 347/49

(58) Field of Classification Search

CPC ..... B41J 25/003; B41J 25/316

USPC ..... 347/49

See application file for complete search history.

(56) References Cited

U.S. PATENT DOCUMENTS 6,092,887 A * 7/2000 Tanino et al. ..... 347/37
6,394,568 B1 5/2002 Menéndez (Continued)

FOREIGN PATENT DOCUMENTS

CN 101380853 A 11/2009
ES 8402096 A1 1/1984

(Continued)

OTHER PUBLICATIONS

International Search Report issued by the International Searching Authority (ISA/O.E.P.M.) on May 23, 2011 in connection with International Application No. PCT/ES2011/070082.

*Primary Examiner* — Shelby Fidler

(74) *Attorney, Agent, or Firm* — Gary J. Gershik; Cooper & Dunham LLP

(57) ABSTRACT

The present invention relates to an adjustment system for adjusting the base of the print head of a plotter with respect to the printing base of the plotter, said base of the head comprising a substantially vertical fixed part (1) and a substantially horizontal adjustable part (2), and it is characterized in that said adjustment means comprise a substantially vertical rotating shaft (4) located between said adjustable part (2) and said fixed part (1); at least one substantially horizontal adjustment element (3) regulating the angular position of said adjustable part (2) with respect to said fixed part (1); and a plurality of substantially vertical adjustment elements (3) regulating the inclination and height of said adjustable part (2) with respect to said fixed part (1). It enables the base of the print head to be regulated easily and precisely, without any play.

3 Claims, 2 Drawing Sheets

(56) References Cited

U.S. PATENT DOCUMENTS

| | | | | |
|---|---|---|---|---|
| 2003/0108868 | A1* | 6/2003 | Richards | 435/6 |
| 2003/0113729 | A1* | 6/2003 | DaQuino et al. | 435/6 |
| 2004/0075713 | A1* | 4/2004 | Takano et al. | 347/37 |
| 2005/0134672 | A1* | 6/2005 | Williams et al. | 347/214 |
| 2009/0147048 | A1 | 6/2009 | Zhao et al. | |
| 2009/0322825 | A1 | 12/2009 | Labar et al. | |
| 2010/0245415 | A1* | 9/2010 | Tsai et al. | 347/8 |

FOREIGN PATENT DOCUMENTS

| | | | |
|---|---|---|---|
| ES | 8704018 | A1 | 4/1987 |
| WO | WO 2007/065191 | A1 | 6/2007 |

* cited by examiner

SYSTEM FOR ADJUSTING THE BASE OF THE PRINT HEAD OF A PLOTTER

This application is a §371 national stage of PCT International Application No. PCT/ES2011/070082, filed Feb. 8,2011, claiming priority of Spanish Patent Application No. P201030174, filed Feb. 9, 2010, the contents of each of which are hereby incorporated by reference into this application.

The present invention relates to an adjustment system for adjusting the base of the print head of a plotter which allows adjusting the position of the base of the print head with respect to the printing base.

BACKGROUND OF THE INVENTION

In plotters, placing print head or print heads in their correct position is of vital importance to achieve a correct plotting.

Particularly, the base on which the print heads are placed must be parallel with respect to the printing base on which the sheet material to be printed slides and the heads must also be perpendicular with respect the shaft on which they slide.

Today, the position of the base of the print head with respect to the printing base is directly adjusted with screws and adjustable parts.

This adjustment system for adjusting the base of the print head with respect to the printing base has the main drawback that a fine adjustment is complicated.

Therefore, there is an obvious need for an adjustment system for adjusting the base of the print head with respect to the printing base of a plotter which allows a fine and easy to perform adjustment without needing to be an expert.

SUMMARY OF THE INVENTION

The adjustment system of the invention successfully solves the mentioned drawbacks, having other advantages which will be described below.

The adjustment system for adjusting the base of the print head of a plotter of the present invention comprising means for adjusting the position of said base of the print head with respect to the printing base of the plotter, said base of the head comprising a substantially vertical fixed part and a substantially horizontal adjustable part, characterized in that said adjustment means comprise:

- a substantially vertical rotating shaft located between said adjustable part and said fixed part;
- at least one substantially horizontal adjustment element regulating the angular position of said adjustable part with respect to said fixed part; and
- a plurality of substantially vertical adjustment elements regulating the inclination and the height of said adjustable part with respect to said fixed part.

As a result of this feature, the base of the print head can be regulated easily and precisely, without any play.

According to a preferred embodiment, said adjustment elements are screws provided with a spring located around its shank.

The spring of said substantially vertical adjustment elements is preferably placed between a support provided in said fixed part and said adjustable part, and the spring of said substantially horizontal adjustment element is preferably placed between a support provided in said adjustable part and said fixed part.

BRIEF DESCRIPTION OF THE DRAWINGS

To better understand the foregoing, several drawings are attached in which a practical case of embodiment is schematically depicted only by way of non-limiting example.

DESCRIPTION OF A PREFERRED EMBODIMENT

Figure 1:
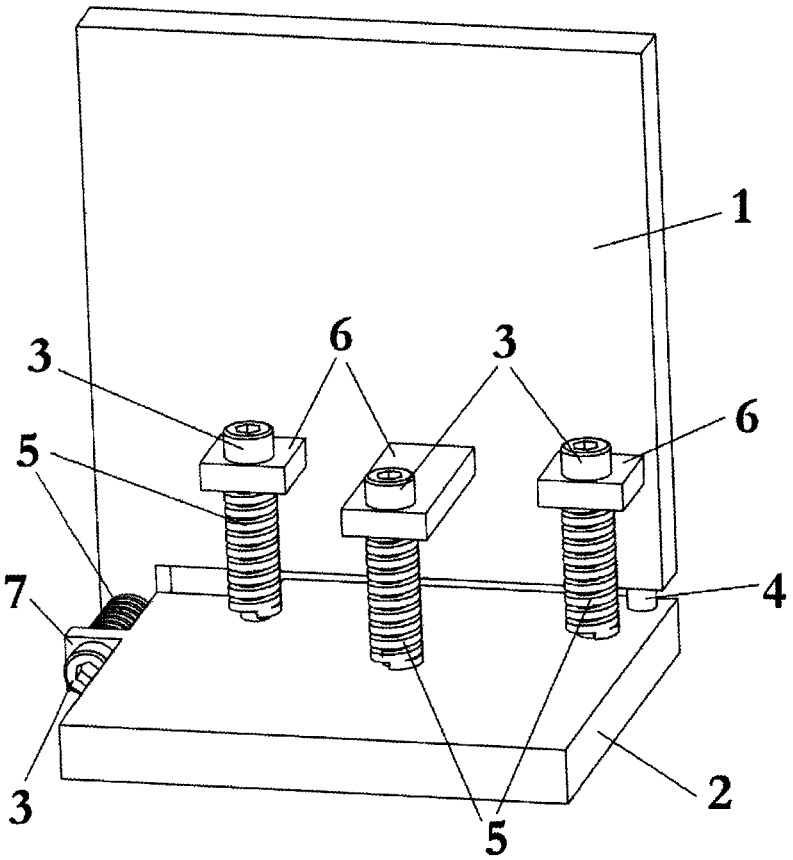
FIG. 1 is a perspective view of a base of the print head or print heads of a plotter provided with the adjustment system of the present invention.

As can be seen in the drawings, the base of the print head of a plotter comprises a substantially vertical fixed part 1 and a substantially horizontal adjustable part 2.

The adjustable part 2 can move vertically and angularly with respect to said fixed part 1. Furthermore, the inclination of the adjustable part 2 can also be adjusted with respect to the fixed part 1.

For the vertical adjustment and inclination, the adjustment system of the present invention comprises a plurality of adjustment elements 3, the embodiment depicted in the drawings have three adjustment elements, even though the adjustment elements could be of any suitable number.

For the angular adjustment, the adjustment system of the present invention comprises a substantially vertical rotating shaft 4 located between said adjustable part 2 and said fixed part 1, particularly at a corner of said adjustable part 2. Furthermore, the adjustment system of the present invention also comprises a substantially horizontal adjustment element 3 located between the fixed part 1 and the adjustable part 2.

Figure 2:
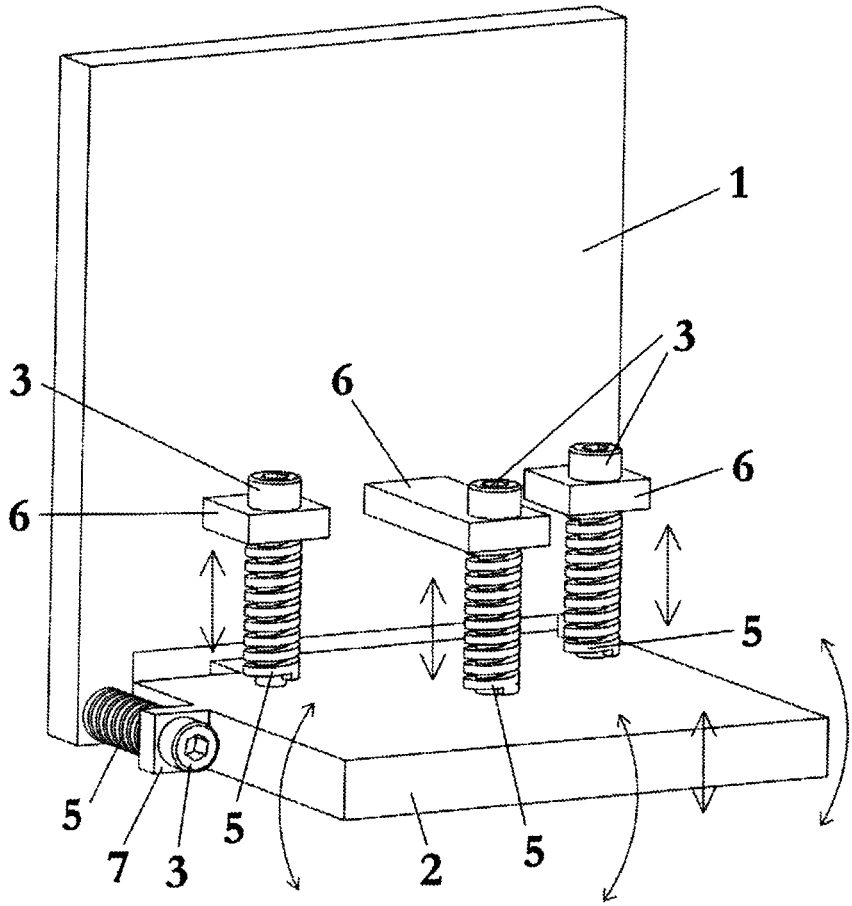
FIG. 2 is a perspective view similar to FIG. 1, in which the different adjustments which can be made by means of the adjustment system of the present invention are shown.

The arrows depicted in FIG. 2 shows the adjustments which can be made by means of the adjustment system of the present invention.

According to the depicted embodiment, said adjustment elements 3 are screws provided with a spring 5 located around its shank.

The spring 5 of said substantially vertical adjustment elements 3 is placed between a support 6 provided in said fixed part 1 and said adjustable part 2, whereas the spring 5 of said substantially horizontal adjustment element 3 is placed between a support 7 provided in said adjustable part 2 and said fixed part 1.

As seen in the drawings, said supports 6, 7 are located such that they are placed between the head of the screws 3 and the springs 5. Therefore, when a screw 3 is tightened, the spring 5 compresses, and when a screw 3 is loosened, the spring 5 decompresses.

The presence of the springs 5 also allows deforming the springs if they are pressed, but at the moment when pressure disappears, the springs 5 return the system to its previous position.

Despite that reference has been made to a specific embodiment of the invention, it is obvious for a person skilled in the art that the adjustment system described is susceptible to various variations and modifications, and that all the details mentioned can be substituted with other technically equivalent details without departing from the scope of protection defined by the claims attached.

The invention claimed is:

1. An adjustment system for adjusting a base of a print head of a plotter, comprising a means for adjusting the position of said base of the print head with respect to the base of the plotter, said base of the head comprising a substantially vertical fixed part (1) and a substantially horizontal adjustable part (2), said substantially vertical fixed part (1) being substantially perpendicular to said substantially horizontal adjustable part (2), wherein the means for adjustment comprises:

a substantially vertical rotating shaft (4) located between said adjustable part (2) and said fixed part (1), said rotating shaft (4) being parallel along its length with the fixed part (1);

at least one substantially horizontal adjustment element (3) regulating the angular position of said adjustable part (2) with respect to said fixed part (1); and a plurality of substantially vertical adjustment elements (3) regulating the inclination and the height of said adjustable part (2) with respect to said fixed part (1), wherein said adjustment elements (3) are screws provided with a spring (5) located around its shank.

2. The adjustment system according to claim 1, wherein the spring (5) of said substantially vertical adjustment elements (3) is placed between a support (6) provided in said fixed part (1) and said adjustable part (2).

3. The adjustment system according to claim 1, wherein the spring (5) of said substantially horizontal adjustment element (3) is placed between a support (7) provided in said adjustable part (2) and said fixed part (1).

* * * * *